US007032888B1

(12) United States Patent
Adair

(10) Patent No.: US 7,032,888 B1
(45) Date of Patent: Apr. 25, 2006

(54) FENCE GUARD CONSTRUCTION

(76) Inventor: Robin A. Adair, 4340 Jan Dr., Carmichael, CA (US) 95608

( * ) Notice: Subject to any disclaimer, the term of this patent is extended or adjusted under 35 U.S.C. 154(b) by 0 days.

(21) Appl. No.: 10/770,187

(22) Filed: Feb. 2, 2004

(51) Int. Cl.
*E04H 17/00* (2006.01)

(52) U.S. Cl. ..... 256/1; 256/19; 256/24; 47/33; 52/102

(58) Field of Classification Search ..... 403/1, 403/19, 24; 47/33; 52/102; 256/1, 19, 24
See application file for complete search history.

(56) References Cited

U.S. PATENT DOCUMENTS

| | | | | |
|---|---|---|---|---|
| 3,762,113 | A * | 10/1973 | O'Mullan et al. | 52/102 |
| 3,768,780 | A | 10/1973 | Cowles et al. | 256/1 |
| 4,349,989 | A | 9/1982 | Snider, Jr. | 47/33 |
| 4,548,388 | A * | 10/1985 | Cobler | 256/32 |
| 5,317,833 | A | 6/1994 | Goldman | 47/33 |
| D427,333 | S | 6/2000 | Anderson et al. | D25/164 |
| 6,070,859 | A * | 6/2000 | Damon et al. | 256/1 |
| 6,561,491 | B1 | 5/2003 | Thompson et al. | 256/1 |
| 6,625,925 | B1 * | 9/2003 | Foster | 47/33 |

* cited by examiner

*Primary Examiner*—Daniel P. Stodola
*Assistant Examiner*—Michael P. Ferguson
(74) *Attorney, Agent, or Firm*—Sturm & Fix LLP

(57) ABSTRACT

A fence guard construction (10) for preventing the growth of vegetation in the vicinity of a fence line (100) wherein, the construction includes end cap members 20 40 and intermediate segments 30 30 each provided with a vertical mounting flange (60) and a horizontal mounting flange (50) and fabricated from hollow rectangular bodies (21) (41) and (31) that are adapted to be connected to one another, as well as, the ground and spaced fence posts (101) wherein, each of the bodies (21) (41) and (31) have external surfaces (24) (34) and (44) provided with a simulated brick appearance.

10 Claims, 2 Drawing Sheets

FENCE GUARD CONSTRUCTION

CROSS REFERENCE TO RELATED APPLICATIONS

Not applicable.

BACKGROUND OF THE INVENTION

1. Field of the Invention

The present invention relates to the field of fence guards for inhibiting the growth of vegetation beneath and adjacent to a fence line and in particular to a new type of fence guard having a unique anchoring arrangement.

2. Description of Related Art

As can be seen by reference to the following U.S. Pat. Nos. 4,349,989; 3,768,780; 5,317,833; and, 6,561,491, the prior art is replete with myriad and diverse fence guard constructions used to prevent grass and weeds from growing under and/or adjacent to a fence line.

While all of the aforementioned prior art constructions are more than adequate for the basic purpose and function for which they have been specifically designed, they are uniformly deficient with respect to their failure to provide a simple, efficient, and practical fence guard construction that not only has an enhanced aesthetic appearance, but which also has an improved and unobtrusive anchoring arrangement for attaching the fence guard construction to the fence posts.

As anyone who has a fence surrounding their property is all too well aware, the difficulty in maintaining a well manicured lawn in the vicinity of the fence line is the biggest problem associated with a fence.

As a consequence of the foregoing situation, there has existed a longstanding need among property owners for a new and improved fence guard construction having an improved decorative appearance and a unique anchoring arrangement; and, the provision of such a construction is the stated objective of the present invention.

BRIEF SUMMARY OF THE INVENTION

Briefly stated, the fence guard construction that forms the basis of the present invention comprises in general a pair of end cap members and a plurality of intermediate segments which all share some of the same structural characteristics, as well as, a generally similar external appearance.

As will be explained in greater detail further on in the specification, the fence guard construction includes a proximal end cap member adapted to releasably receive the first of a series of identical intermediate segments that are adapted to interlock with one another.

In addition, a distal end cap member is virtually a mirror image of the proximal end cap member with the exception of a mounting flange formed on the open end of the distal end cap member wherein, the mounting flange is adapted to releasably engage the distal end of the last of the identical intermediate segments.

Furthermore, both of the end cap members and the intermediate segments are provided with both vertically and horizontally aligned mounting flanges that allow the fence guard construction to be affixed both to a plurality of fence posts, as well as, anchored to the ground adjacent to the fence line.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
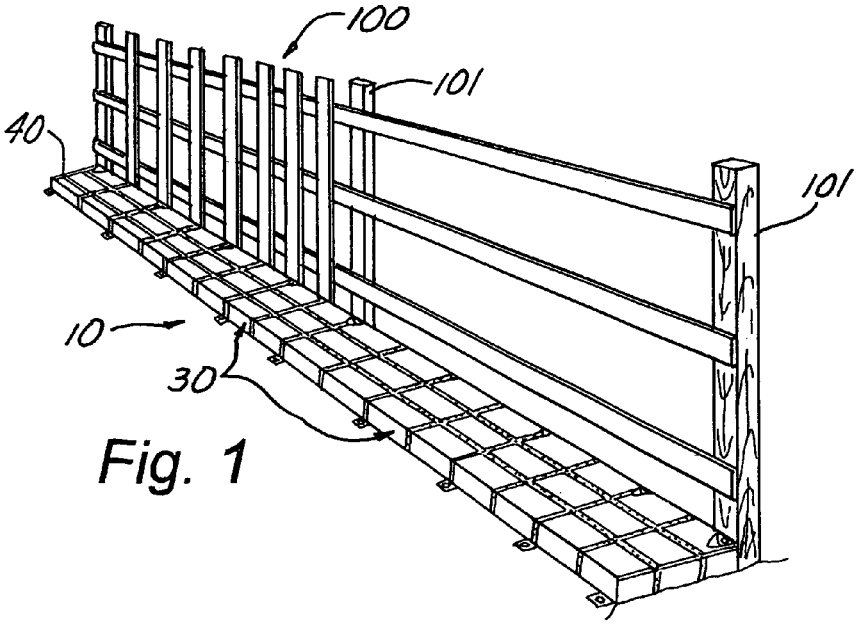
FIG. 1 is a perspective view of a fence line provided with the fence guard construction that forms the basis of the present invention.

As can be seen by reference to the drawings, and in particular to FIG. 1, the fence guard construction that forms the basis of the present invention is designated generally by the reference number 10. The construction 10 comprises a proximal end cap member 20, a plurality of intermediate segments 30 and a distal end cap member 40. These structural elements will now be described in seriatim fashion.

Figure 3:
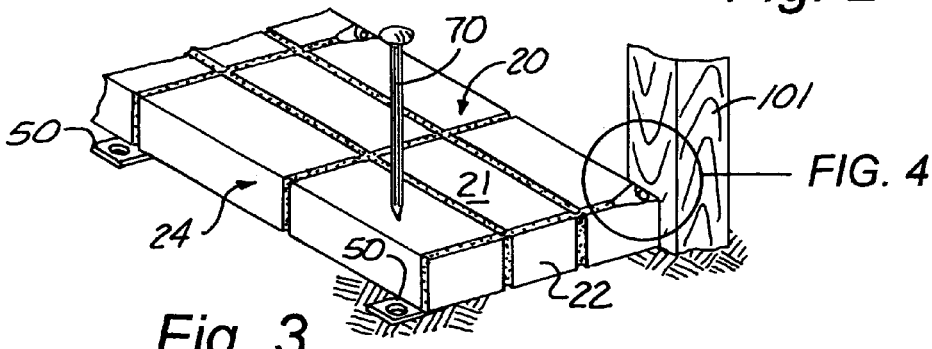
FIG. 3 is a perspective view of the proximal end cap member.

As can best be seen by reference to FIG. 3, the proximal end cap member 20 comprises a hollow elongated rectangular body 21 preferably fabricated from plastic and having an open distal end (not shown) and a closed proximal end 22 wherein, the external surfaces 24 of the hollow body 21 are further provided with a simulated brick appearance.

Figure 2:
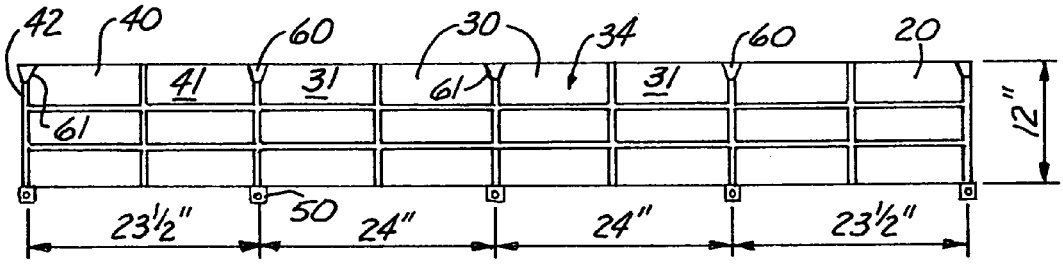
FIG. 2 is a top plan view of a representative fence guard construction.
Figure 6:
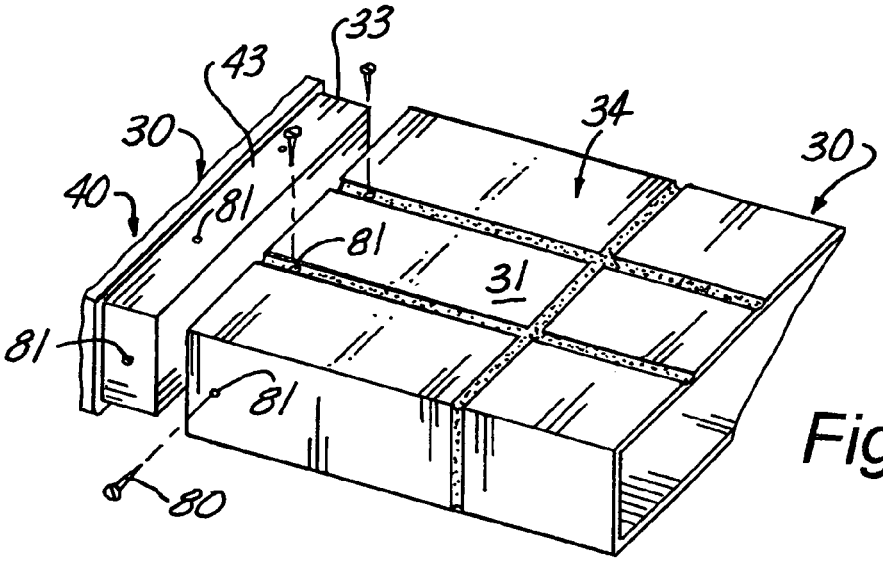

Turning now to FIGS. 1,2, and 6, it can be seen that the plurality of intermediate segments 30 each comprises an open ended hollow elongated rectangular body 31 wherein, the external surfaces 34 of the hollow bodies 31 are all provided with a simulated brick appearance and the proximal end of each of the intermediate segments 30 is provided with a connector flange 33 that is dimensioned to engage the distal end of each of the other intermediate segments 30, as well as, the distal end of the proximal end cap member 20.

As can also be appreciated by reference to FIGS. 1,2, and 6, the distal end cap member 40 comprises a hollow elongated rectangular body 41 having a closed distal end 42 wherein, the open proximal end of the body 41 is provided with a connector flange 43 adapted to engage the distal end of any of the intermediate segments 30.

Figure 5:
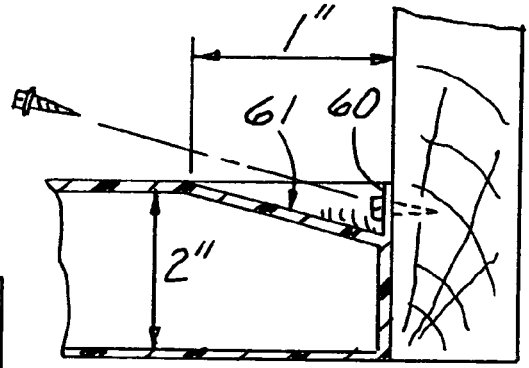
FIG. 5 is a cross-sectional view taken through line 5—5 of FIG. 4; and, FIG. 6 is a detail view showing the typical flanged engagement between two of the distal end cap member, the intermediate segments, and the proximal end cap member, respectively.
Figure 4:
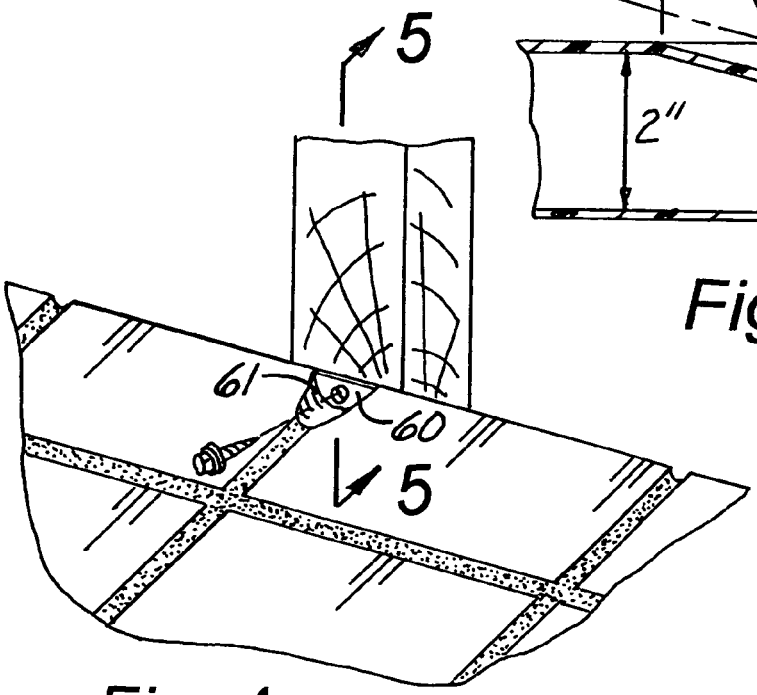
FIG. 4 is an enlarged detail view of the circled portion of FIG. 3.

Turning now to FIGS. 3 through 5, it can be seen that each of the end cap members 20 40, as well as, the intermediate segments 30 30 is provided with both horizontal 50 and vertical 60 apertured mounting flanges wherein, the horizontal mounting flanges 50 extend outwardly from the bottom of the cap members 20 40, as well as, the segments 30 and are dimensioned to receive an elongated ground penetrating spike 70.

Furthermore, the vertical mounting flanges 60 are formed in the rear wall of the end cap members 20 40 and the segments 30 at the terminus of a semi-conical recess 61 formed on the top surface of each end cap member 20 40 and segment 30 wherein, the vertical mounting flanges 60 are dimensioned to receive conventional fasteners 80 for securing the end cap members 20 40 and the segments 30 to spaced fence posts 101 along a fence line 100.

Turning now to FIG. 6, it can also be seen that a plurality of discrete apertures 81 may be formed in the mating surfaces of the fence guard construction 10, wherein, the apertures 81 are dimensioned to receive conventional fasteners 80 for fixedly securing the mating components together in a well recognized fashion.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A fence guard construction for preventing the growth of vegetation in the vicinity of a fence wherein, the construction comprises:

a first end cap member including a closed end elongated hollow rectangular body having a substantially rectangular shaped open space therein and an open distal end;

a second end cap member including a closed end elongated hollow rectangular body having a substantially rectangular shaped open space therein and an open proximal end provided with a connector flange;

at least one intermediate segment including an open ended elongated hollow rectangular body having a substantially rectangular shaped open space therein and a connector flange disposed on one of the open ends;

the first and second end cap members, as well as, the at least one intermediate segment have their external surfaces provided with a simulated brick appearance;

each of the end cap members is provided with at least one horizontal mounting flange and at least one vertical mounting flange; and a fence post disposed in soil for holding the fence post upright and said vertical mounting flange is directly attached to said fence post with a fastener.

2. The construction as in claim 1; wherein, said at least one vertical mounting flange is formed in a rear wall portion of the hollow rectangular bodies and at the terminus of a semi-conical recess formed in a top surface of the hollow rectangular bodies.

3. The construction as in claim 1; wherein, the at least one intermediate segment is provided with at least one vertical mounting flange and at least one horizontal mounting flange.

4. The construction as in claim 3; wherein, said at least one vertical mounting flange is formed in a rear wall portion of the hollow rectangular bodies and at the terminus of a semi-conical recess formed in a top surface of the hollow rectangular bodies.

5. A fence guard construction for preventing the growth of vegetation in the vicinity of a fence wherein, the construction comprises:

a first end cap member including a closed end elongated hollow rectangular body having a substantially rectangular shaped open space therein and an open distal end, a second end cap member including a closed end elongated hollow rectangular body having a substantially rectangular shaped open space therein and an open proximal end provided with a connector flange which is adapted to be received in the open distal end of the first end cap member;

each of the end cap members is provided with at least one horizontal mounting flange and at least one vertical mounting flange; and a fence post disposed in soil for holding the fence post upright and said vertical mounting flange is directly attached to said fence post with a fastener.

6. The construction as in claim 5 further comprising:

at least one intermediate segment including an open ended elongated hollow rectangular body having a connector flange disposed on one of the open ends.

7. The construction as in claim 6; wherein, the first and second end cap members, as well as, the at least one intermediate segment have their external surfaces provided with a simulated brick appearance.

8. The construction as in claim 6; wherein, the at least one intermediate segment is provided with at least one vertical mounting flange and at least one horizontal mounting flange.

9. The construction as in claim 8; wherein, said at least one vertical mounting flange is formed in a rear wall portion of the hollow rectangular bodies and at the terminus of a semi-conical recess formed in a top surface of the hollow rectangular bodies.

10. The construction as in claim 5; wherein, said at least one vertical mounting flange is formed in a rear wall portion of the hollow rectangular bodies and at the terminus of a semi-conical recess formed in a top surface of the hollow rectangular bodies.

* * * * *